United States Patent [19]

Hachey et al.

[11] Patent Number: 4,627,119

[45] Date of Patent: Dec. 9, 1986

[54] APPARATUS TO ASSIST THE DISABLED

[75] Inventors: Francis J. Hachey, North Reading; Henry J. Hachey, Fitchburg, both of Mass.

[73] Assignee: ParaSystems, Inc., Waltham, Mass.

[21] Appl. No.: 693,294

[22] Filed: Jan. 22, 1985

[51] Int. Cl.[4] ..... A61G 7/10

[52] U.S. Cl. ..... 5/83; 5/85; 5/89

[58] Field of Search ..... 5/83, 84, 85, 88, 89, 5/120, 122, 123; 297/273, 276, 278, 281; 403/121

[56] References Cited

U.S. PATENT DOCUMENTS

| | | | |
|---|---|---|---|
| 9,215 | 8/1852 | Hopkins . | |
| 33,545 | 10/1861 | Ruth . | |
| 841,702 | 1/1907 | Martin | 5/89 |
| 1,051,728 | 1/1913 | German . | |
| 1,477,110 | 12/1923 | Cross | 297/278 |
| 1,709,153 | 6/1926 | Pownall . | |
| 3,123,224 | 11/1962 | Kral . | |
| 4,138,750 | 2/1979 | Michalowski | 5/89 |
| 4,202,064 | 5/1980 | Joergensen | 5/83 |
| 4,243,147 | 1/1981 | Twitchell et al. | 5/89 |
| 4,372,452 | 2/1983 | McCord | 5/85 |
| 4,446,587 | 5/1984 | Jump | 5/83 |

FOREIGN PATENT DOCUMENTS

| | | | |
|---|---|---|---|
| 1275380 | 9/1961 | France | 5/85 |
| 789468 | 1/1958 | United Kingdom | 5/83 |
| 1080511 | 8/1967 | United Kingdom | 5/83 |

OTHER PUBLICATIONS

ITEC, Independence brochure.
Skandi-Lift, brochure.
Skandi-Lift, Nursing Homes.
Invacare Electric Lift form 81-114.
Invacare Electric Lift Models 9911 and 9912.

*Primary Examiner*—Gary L. Smith
*Assistant Examiner*—Michael F. Trettel
*Attorney, Agent, or Firm*—Lahive & Cockfield

[57] ABSTRACT

Disclosed is apparatus to assist the disabled comprising a cradle assembly made of flexible support material suspended by first and second elongate, independently adjustable pairs of support members suspended from a pair of horizontal support rails. The support members connect to the cradle at spaced-apart head and foot lifting points and are mounted for sliding movement along the rails. A control for adjusting the length of the respective pairs of support members enable the disabled person to be lifted into a sitting or prone position above a bed and to be transferred comfortably to a wheelchair.

11 Claims, 12 Drawing Figures

APPARATUS TO ASSIST THE DISABLED

TECHNICAL FIELD

The technical field of this invention is medical devices and, in particular, devices for home, hospital, and institutional use in assisting disabled individuals.

BACKGROUND

Disabled persons must often resort to manual assistance in transferring from a bed to a wheelchair and vice versa. Likewise, washing, dressing, and toilet activities can often require assistance in movement. Even chronically bedridden individuals require lifting to relieve pressure points and avoid sores or to permit physical therapy.

Lifts of various kinds, mechanical and motorized, have been employed in the past to assist disabled persons. Modern lifts typically take the form of hoists with belts or a seat. The support for the belts or seat is typically a single cable served by a hoist mechanism, e.g., a hydraulic or pneumatic cylinder.

There exists a need for better devices for use in institutions, homes, and hospital settings to assist disabled persons. Devices which are portable or easily assembled and which operate smoothly and safely would satisfy long-felt needs.

SUMMARY

A motorized, lifting device is disclosed having at least two independently articulating support members and a cradle, including a stabilizing cradle support structure, adapted to receive the support members during lifting operations. The cradle is designed so that it can be slipped easily beneath the individual and connected to the support members. Additionally, the motors are operated by a simple set of controls, which can be manipulated by the disabled person or by an aide.

In one aspect of the invention, the cradle is formed from a flexible material, such as a nylon based fabric or the like, and includes at least two lifting points which are adapted for connection to the two independently articulating support members. The first and second lift points are connected by a stabilizing bar which, when assembled, forms a portion of a cradle structure for the disabled individual. In one preferred embodiment, four lift points (a head and foot lift point on each side) are employed with two side stabilizer bars connecting the head and foot lift points of each side together. The lift points and the stabilizer bars are preferably connected by rings or swivel joints to permit a high degree of relative movement. Additionally, the cradle preferably includes an adjustable head bar and transverse stiffening means. The cradle can also include a central hole, beneath which a bed pan can be placed in use, or a two-part structure described hereinafter which facilitates positioning the cradle beneath the disabled individual while he or she is in a prone or sitting position.

The motorized lifting assembly is disposed upon at least one overhead support rail which extends horizontally. When the apparatus is disposed above a bed, the extending support rail permits the transfer of the individual over one end or side of the bed into a wheelchair or the like. Additionally, the lifting assembly and the support rail permits the simple lifting of the disabled person for bathing, changing of bedclothes, or toilet activities. Moreover, the head end and foot end support members may be lifted individually by the lifting assembly to allow for physical therapy, reading in bed, or the placement in traction of broken bones. The cooperation of the independently articulating support members, the flexible cradle, and the cradle support structure which includes stabilizing bars and swiveling connectors, permits a wide degree of freedom in movement, an extremely comfortable ride or lift for the disabled person, and easy positioning of the person in bed or in a wheelchair.

Preferably, two parallel support rails are employed and the lifting assembly is disposed therebetween. The horizontal support rails may be supported by upright post members or may be mounted into the ceiling of a room. When, as perferred, upright posts are employed, the device can be provided with wheels and, in one preferred embodiment, the width and height of the overall apparatus are chosen so that it can pass through hospital or home doorways.

In yet another aspect of the invention, bearings are provided for the smooth sliding of the lifting assembly along the support rails. The assembly, encased in a carriage and supported by the bearings, can be moved along the rails either manually or by motorized control. In one preferred embodiment, the bearings are U-shaped and lined with Teflon or similar self-lubricating fluorocarbon polymer materials. In this embodiment, each of the U-shaped bearings rides upon a rounded surface of the support rail and the contacting surfaces are steel balls set into the U-shaped bearings to provide nearly frictionless operation. Moreover, floating connectors at each bearing connect the bearing with the frame of the lifting assembly and, thereby, provide for a significant degree of self-correction of misalignment between the two support rails.

In one preferred embodiment, the lifting assembly includes two separate motors for operating the independently articulating support members. In this embodiment, each motor drives a shaft which causes pulleys to turn at opposite ends of the shaft in unison. Each pulley raises or lowers a support member, for example, a nylon belt, connected to the cradle. Thus, in this embodiment, four support members are connected to the cradle, with two members operating in unison to lift the head end of the cradle and two members operating in unison to lift the foot end of the cradle. The lifting assembly can also include limiting safety switches disposed about the pulleys such that winding up the support members beyond a predetermined point will result in automatic shutoff of the lifting motors. The lifting assembly can also include safety brakes which secure the front and rear shafts from turning when the power is off, either intentionally or due to a power failure. The safety brakes operate to prevent a sudden or uncontrolled drop of the individual. A manual override can also be provided for power failure situations.

Another safety feature which can be included in the lifting assembly is a sensor plate at the bottom of the overhead carriage which activates a shutoff switch in the event that any portion of the disabled person's body comes in contact with the lifting assembly. Moreover, the lifting assembly can be powered by house current or by batteries and, for hospital settings where oxygen gas is employed, non-sparking motors can be used. All the lifting assembly elements can be encased in an overhead carriage and operated by a remote control device connected to the carriage by an electrical cord or a wireless remote transmitter.

The invention will next be described in further detail in connection with certain illustrated embodiments. However, it should be clear that various changes and modifications can be made to the invention as illustrated without departing from the spirit or scope of the claims.

BRIEF DESCRIPTION OF THE FIGURES

Like reference characters in the respective drawn figures indicate corresponding parts.

DETAILED DESCRIPTION

Figure 1:
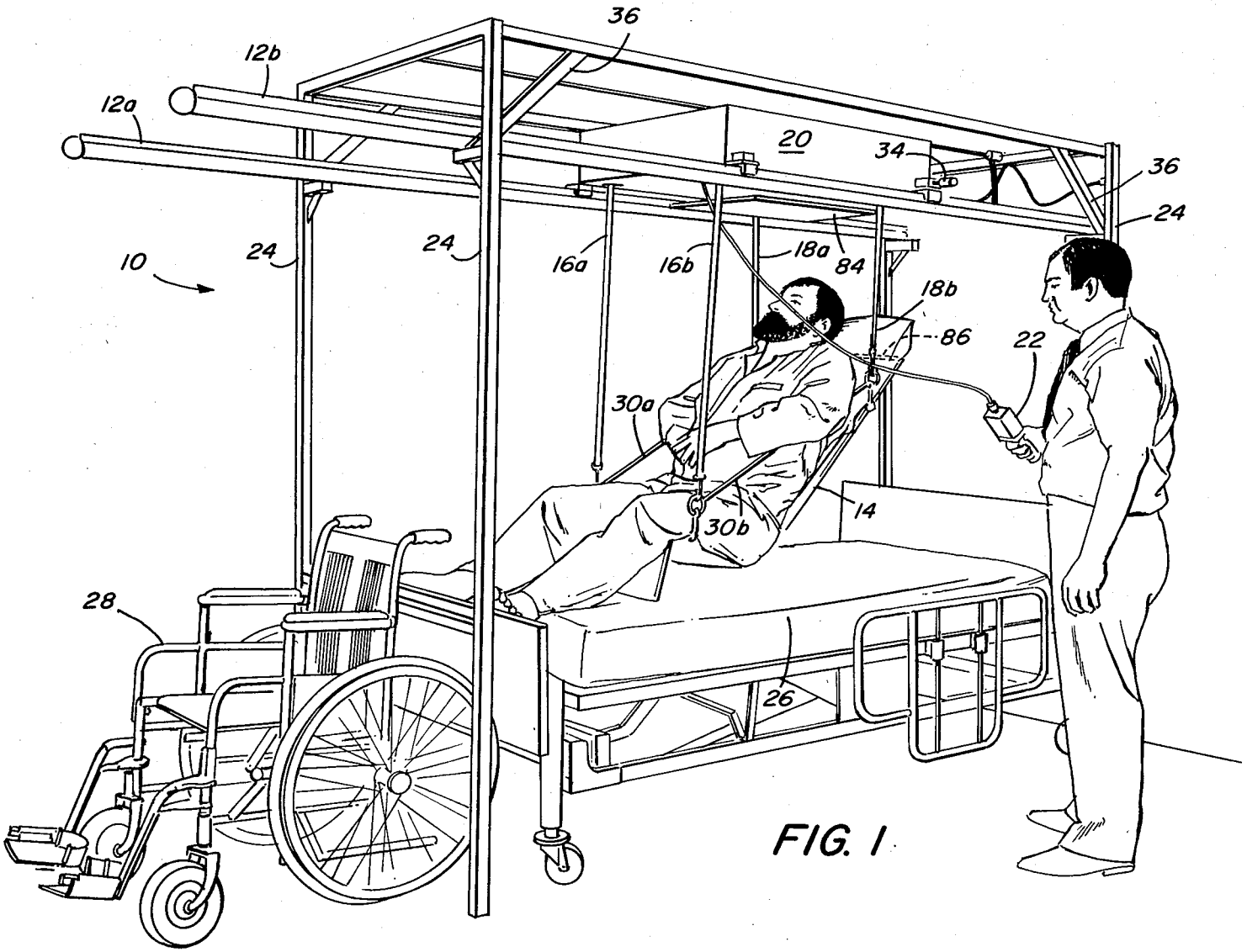
FIG. 1 is a perspective view of a lifting apparatus for assisting disabled individuals according to the invention.

FIG. 1 shows an embodiment 10 of the apparatus of the present invention in place above a bed 26. The apparatus includes two horizontally extending support rails 12*a*, 12*b* and a carriage 20 disposed therebetween. A set of two head end support members 18*a*, 18*b* and a set of foot end support members 16*a*, 16*b* extend from the carriage 20 to a cradle 14 (in which a disabled person is shown). In the illustrated embodiment, the horizontal support rails 12*a*, 12*b* are supported by four upright posts 24 which may be disposed on wheels (not shown) and the carriage is connected to the horizontal rails 12 by bearings 40 which permit movement along the rails. Bumpers 34 cooperate with bumper engaging stops 36 to limit the motion of the carriage. A remote control device 22 (shown operated by an aide) permits an operator to lift cradle 14 by the foot end support members 16*a*, 16*b* or the head end support members 18*a*, 18*b* independently, or both simultaneously. As shown, the disabled person has been lifted off the bed and the cradle is ready for horizontal movement along rails 12 over one end of the bed for relocation of the individual in a wheelchair 28.

Figure 2:
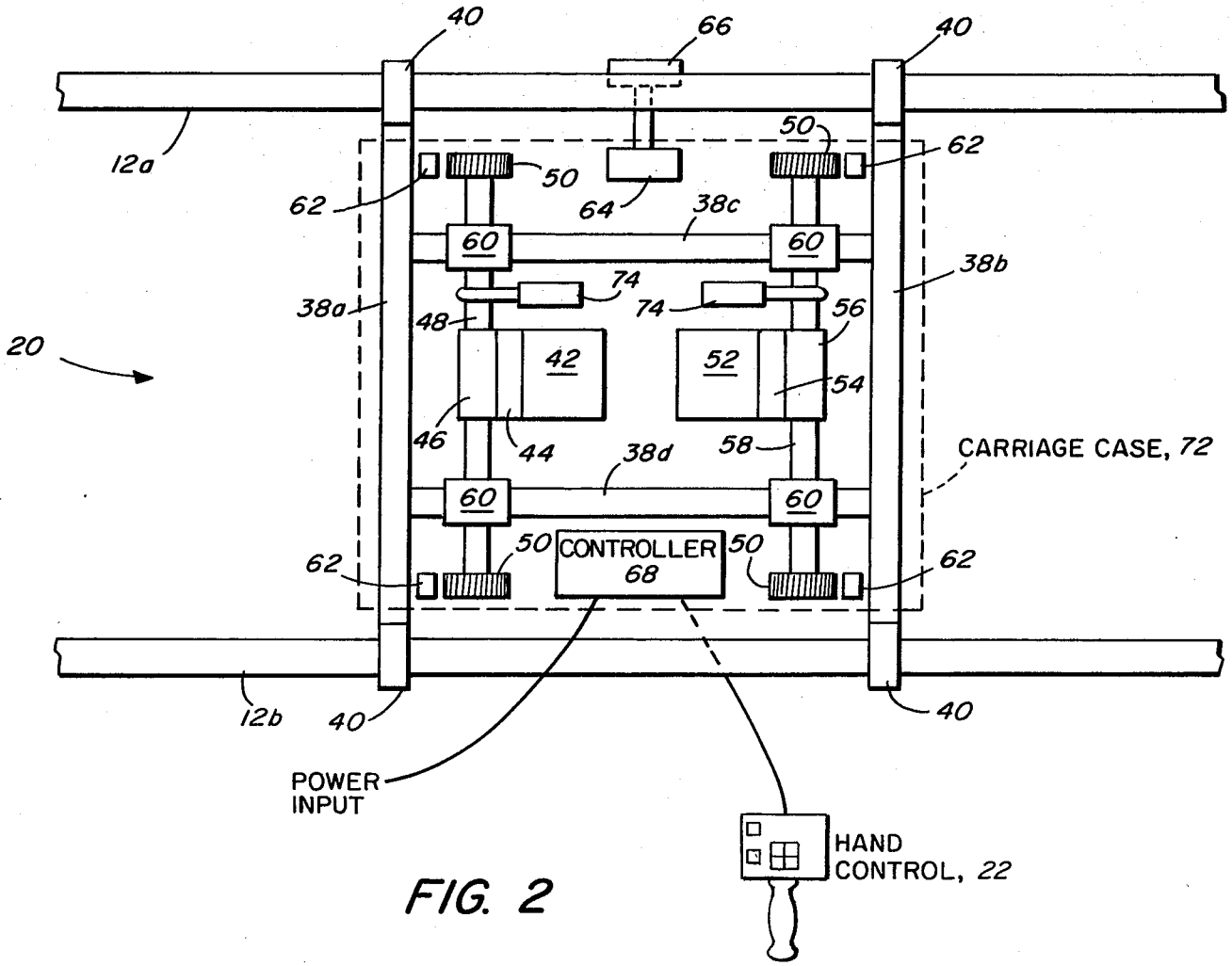
FIG. 2 is a top plan view of the lifting assembly of the apparatus of FIG. 1.

FIG. 2 is a top view of the carriage 20 showing the components of the lifting assembly, including frame elements 38*a*, 38*b*, 38*c*, and 38*d* which form a rectangular support grid. Transverse frame elements 38*a* and 38*b* extend over the support rails 12*a* and 12*b* and allow the connection of the carriage 20 to the rails by bearings 40. The carriage 20 also includes reversible lifting motors 42 and 52, respectively. Motor 42 is connected to a reducing gear box 44 which, in turn, is connected to a driving gear 46 which causes shaft 48 to rotate. Motor 52 is connected to a reducing gear box 54, and driving gear 56 to turn shaft 58.

Both the foot end shaft 48 and the head end shaft 58 include pulleys 50 disposed at each end. Around these four pulleys 50 the supports 16*a*, 16*b* and supports 18*a*, 18*b* are wrapped. Operating the motor 42 in one direction, therefore, causes the supports to raise the foot end portion of the cradle while operating the motor 42 in the opposite direction causes the supports to lower the foot end portion of the cradle. Similarly, motor 52 controls the raising and lowering of the head end portion of the cradle. The shafts 48, 58 are each connected to the frame elements by bearings 60. Limiting switches 62 are disposed adjacent each of the pulleys 50 to shut off the motors if the support elements 16, or 18, are raised beyond a predetermined amount.

Optionally, the lifting assembly can also include a third motor 64 to assist in transporting the carriage (and the attached cradle) horizontally. Motor 64 is shown connected to a drive gear 66 which engages a suitable friction or gear track on rail 12*a*. The motors, switches, and other electrical elements of the lifting assembly are operated by controller 68, e.g., a low voltage DC controller, which is equipped with a hand control device 22 for use by the disabled person or an aide. Other control mechanisms, operable, for example, by mouth movements of a severly disabled person, may be substituted for the illustrated hand controller 22. Brakes 74 are disposed about both shafts 48 and 58 to ensure that the cradle is not dropped when the motors are inactivated. The lifting assembly can be powered by direct current from batteries or, preferably, by distributed alternating current. The electrical power lines can be connected to a wall outlet and passed through one of the upright posts 24 (shown in FIG. 1) to the top of the apparatus. In one preferred embodiment, the power cord is supported on a horizontal rail by bushings or annular plastic rings that allow the cord to follow the carriage as it moves forwards and backwards and yet remain untangled. The entire lifting assembly, as shown in FIG. 2, can be enclosed in a carriage case 72, shown in dotted lines.

Figure 3:
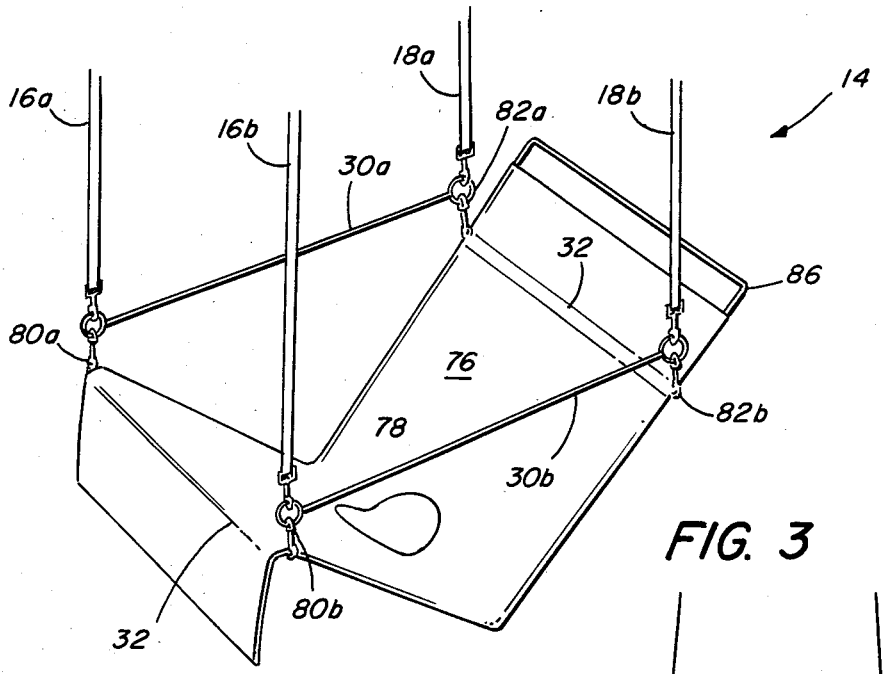
FIG. 3 is a perspective view of one type of cradle and support structure for use with the apparatus of FIG. 1.

FIG. 3 is a detailed perspective view of one embodiment of a cradle, cradle support structure, and support members of the present invention. The cradle assembly 14 includes a first set of left and right foot end lift points 80*a* and 80*b*, respectively, and a second set of left and right head end lift points 82*a* and 82*b*, respectively. The foot end lift points are designed to lift the disabled person behind the knees while the head end lift points serve to provide support at the person's shoulder blades. Because the cradle itself is a fabric material, it will adjust to a wide range of body sizes. An adjustable headrest frame 86 is also shown. Each of the lift points shown in FIG. 2 is formed with a clip for connection to the stabilizing bars 30*a* and 30*b* as well as the four support members 16*a*, 16*b*, 18*a*, and 18*b*. In the illustrated embodiment, the clips extend slightly beyond the fabric portion 76 of the cradle 14 and are formed integral with one or another stiffening bars 32 that passes transversely through the fabric 76. As shown in the illustrated embodiment, the stabilizing bars 30 may be formed with open rings at each end and the support members also include clips. The cradle and support members are assembled by connecting the lift points 80*a*, 82*a* on the left side to the opposite ends of stabilizing bar 30*a* and then connecting the left rear and front support members 16*a* and 18*a*, respectively, to the stabilizing bar 30*a*. A similar assembly step connects the right lift points 80*b* and 82*b* to the right stabilizing bar 30*b* and the right support members 16*b* and 18*b*. Moreover, the cradle fabric 76 can be formed with a central hole 78 to permit toilet activities.

Figure 7:
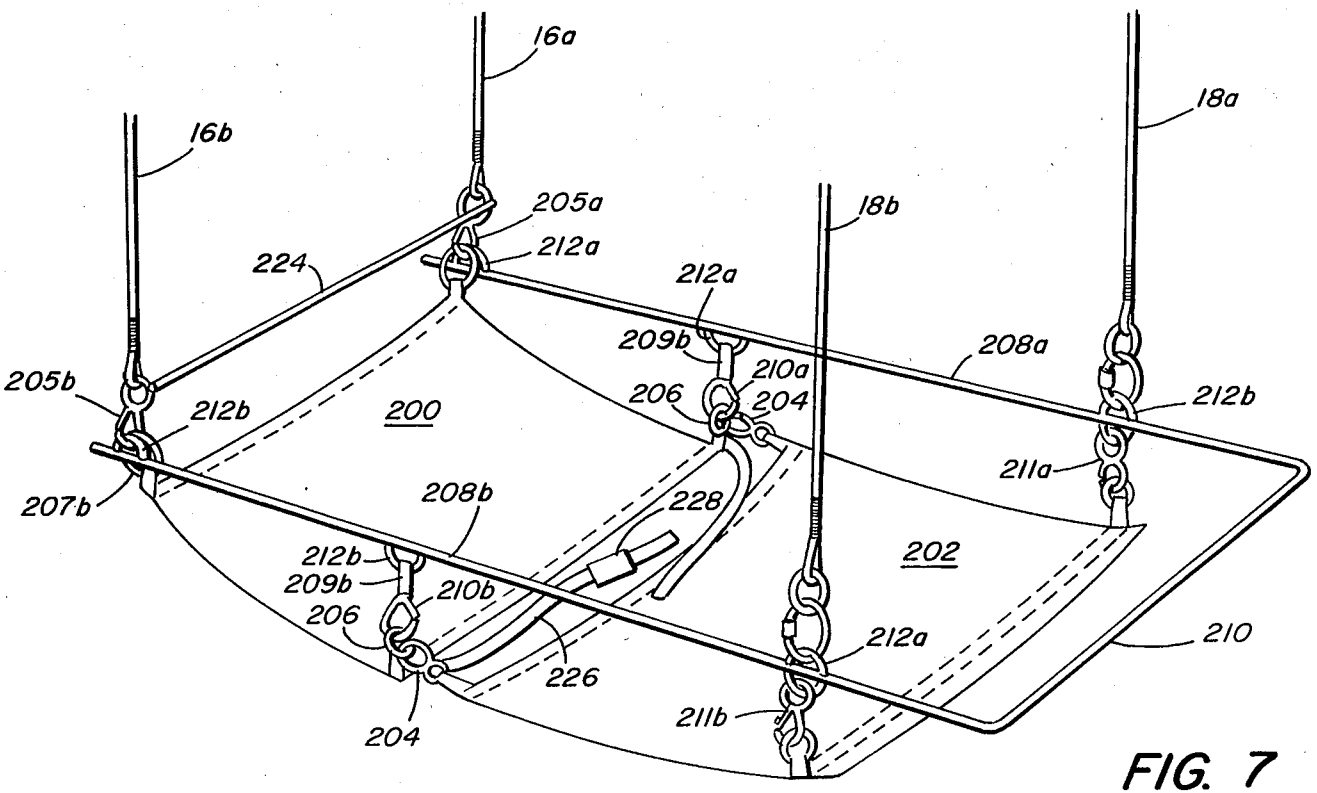
FIG. 7 illustrates a preferred cradle and cradle support structure for use with the apparatus of FIG. 1.

FIG. 7 illustrates a second embodiment of a cradle structure for use in situations where the person is severly disabled and is difficult to move. Like the embodiment of FIG. 3, it comprises a fabric cradle and rigid cradle support structure. However, the cradle comprises separate front end and head end cradle portions 200, 202, respectively, which are connected by means of clips 204 and rings 206. Additionally, stabilizing bars 208*a* and 208*b* are connected by a transverse stiffener bar 210 and include integral loops 212*a* and 212*b* for connecting the cradle portions 200, 202 and support members 16 and 18. Clips 205*a* and 205*b* mate with rings 207*a* and 207*b* of cradle portion 200 and with integral loops 212*a* and 212*b*. Attached to middle integral loops 212*a* and 212*b* are straps 209*a* and 209*b* and clips 210*a* and 210*b* which mate with rings 206 to support the adjacent ends of cradle portions 200 and 202. Clips 211*a* and 211*b* mate with rings 213*a* and 213*b* to support the head end of cradle portion 202. Links 220*a* and 220*b* connect support members 18*a* and 18*b* with head end integral loops 212*a* and 212*b*. A traverse stabilizing bar 224 may be included to aid in maintaining a planar configuration of cradle portions 200 and 202. An adjustable belt 226 with a conventional clasp 228 serves to keep the disabled person from sliding partway through the space between the cradle portions.

In use, the cradle of FIG. 7 reduces the effort required to prepare the disabled individual for repositioning. For example, if the person is located in a wheelchair, cradle portion 200 may be slid beneath the legs and a portion of the buttocks of the patient and cradle portion 202 positioned behind the back without lifting the individual. After connecting the two cradle portions, with the support members 16 and 18 disposed above the location of the individual, the various openable links and clips are connected as shown in FIG. 7, after which the apparatus is actuated to lift the individual out of the wheelchair. Other arrangements of rings, clips, or other fastening means may be devised to achieve the same purpose.

Figure 4A:
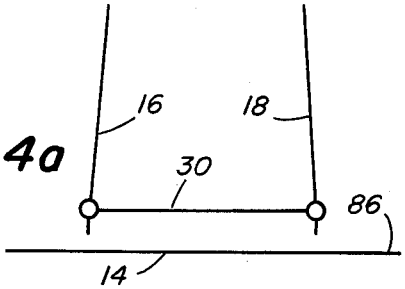
FIGS. 4*a*–4*d* are schematic drawings of a cradle and support structure according to the invention, illustrating the independent of head and foot portions of the cradle.
Figure 4B:
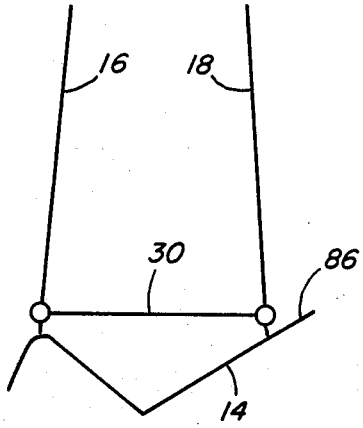
Figure 4C:
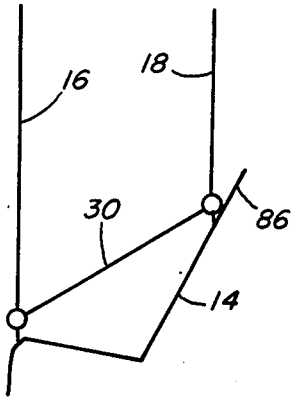
Figure 4D:
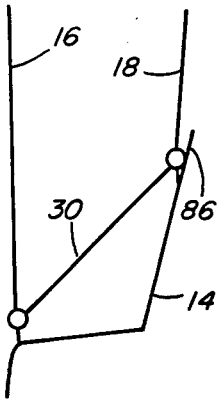

FIG. 4*a*–4*d* show four views of the cradle of FIG. 3 schematically as one set of support members 16, 18 perform their lifting function. In FIG. 4*a*, the cradle 14 is shown in a horizontal position. The cradle 14 is typically disposed in this manner after it is slipped beneath a prone disabled person. Once the disabled person is properly situated on the cradle, the supports 16 and 18 are connected via the stabilizing bars 30 as described above in connection with FIG. 3. In FIG. 4*b*, the cradle is shown with the support members 16 and 18 partially wound up so as to lift both the head and foot portion of the cradle. In FIGS. 4*c* and 4*d*, the cradle is shown with support member 18 further wound up so that the person in the cradle is in a sitting position. As can be seen from FIGS. 4*b* and 4*c*, the stabilizing bar 30 serves to ensure that a comfortable shape is maintained during lifting and that the disabled person is secured so as not to fall out of the cradle. The cooperation between the independently-articulating support members 16 and 18, the swiveling clips and rings of the lift points 80 and 82, and the stabilizing bars 30, permits a wide degree of freedom in movement, resulting in a comfortable cradle for the disabled person which alters its shape in response to the adjustments in length of the support members, 16 and 18.

The cradle of FIG. 7 works in the same way, but transverse stabilizer bars 210 and 224 further ensure that a comfortable cradle shape is maintained.

Figure 5:
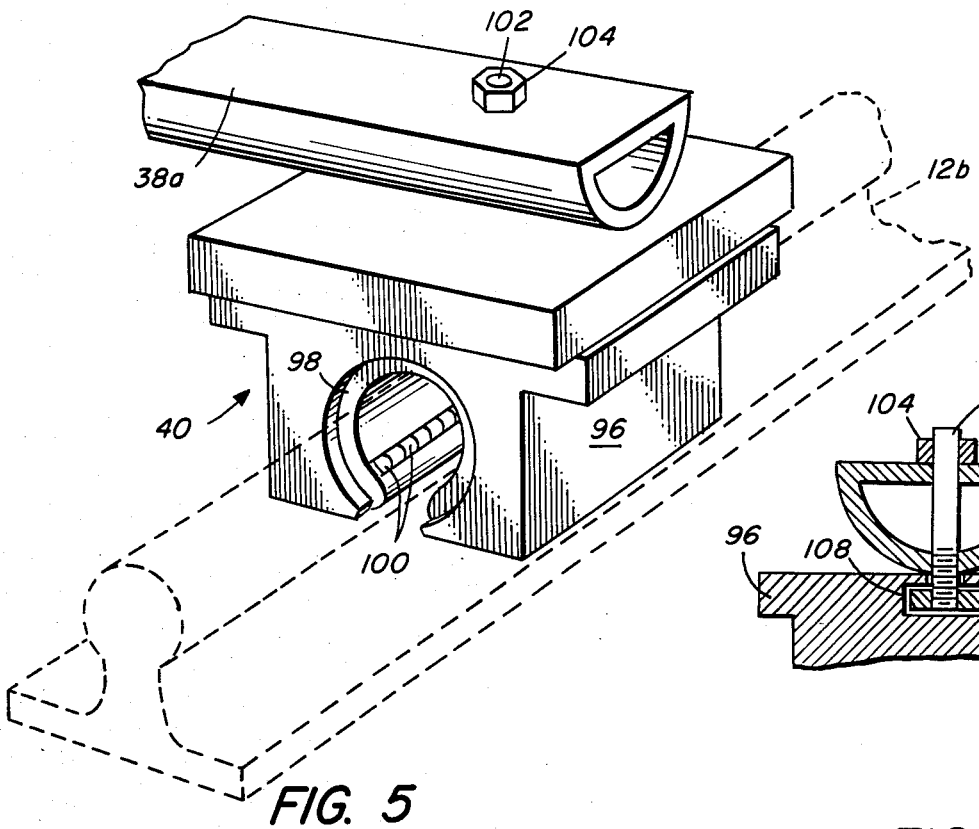
FIG. 5 is a perspective view of a bearing supporting the lifting assembly of the present invention on its support rail.
Figure 5A:
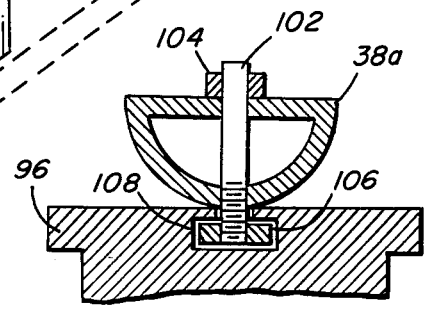
FIG. 5*a* is a cross-sectional end view of the bearing of FIG. 5 showing its connection to the frame of the lifting assembly.

In FIGS. 5 and 5*a*, the bearing 40 discussed above in connection with FIG. 2 is shown in more detail. The bearing's relationship to the support rail is illustrated by the phantom depiction of the support rail 12*b*. The bearing 40 includes a housing 98 and a generally U-shaped internal cavity lined with Teflon or other material that has low friction qualities. The shape of the internal cavity 98 is designed to mate with the shape of the support rail 12*b*. The bearing 40 actually contacts the support rail 12*b* only by steel ball bearings 100 which are situated in longitudinal grooves inside the cavity 98. The bearing 40 itself is connected to the frame of the lifting assembly 38*a* via a bolt 102 which is secured by a nut 104. Although only one bearing 40 is shown, four identical bearings connect each end of frame members 38*a* and 38*b* to the support rails 12*a* and 12*b*.

In FIG. 5*a*, the connection between one of the bearings 40 and the frame member 38*a* is shown in more detail. Because the two support rails 12*a* and 12*b* may not be perfectly parallel, a mechanism is disclosed to correct any misalignment. In the illustrated embodiment, the bolt 102 is secured to the bearing housing 96 by a floating anchor 108 disposed within a cavity 106. Thus, the frame element 38*a* is bolted to the bearing 40 in a fashion that permits considerable relative movement. This ensures smooth horizontal movement of carriage 20 along rails 12*a* and 12*b* despite misalignment caused, for example, by non-level floors.

Figure 6A:
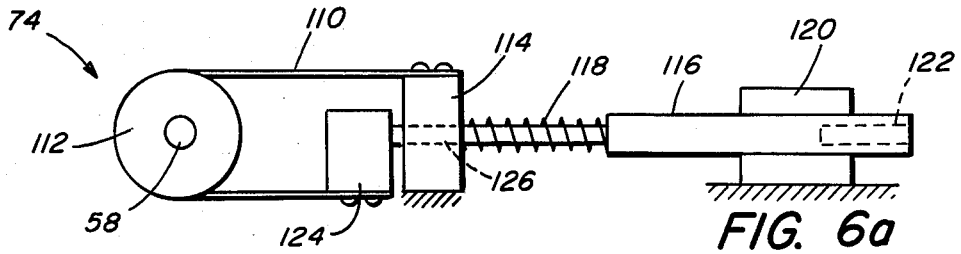
FIGS. 6*a* and 6*b* show a safety brake according to the invention in the locked and unlocked positions, respectively.
Figure 6B:
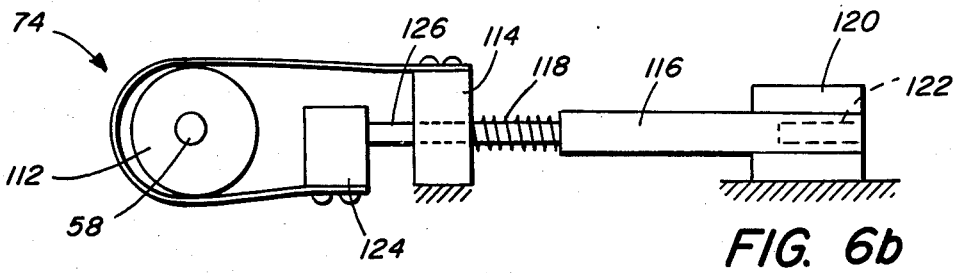

FIGS. 6*a* and 6*b* show the operation of the strap brake 74 which serves to prevent the rotation of shaft 58 (and a consequent unintentional lowering of the cradle) when the motor is shut off or interrupted. An identical brake 74 may be disposed about shaft 48. Each brake 74 consists of a fixed solenoid 120 and a fixed block 114. The shaft 58 is fitted with a V-groove pulley 112 about which is wrapped a strap 110, which preferably takes the shape of a truncated cone in cross-section. One end of the strap 110 is secured to the fixed block 114 while the other end of the strap 110 is secured to a movable block 124. Shaft 26 connects the movable block 124 to a yoke 116 situated about the solenoid 120. The yoke 116 also includes a core plunger 122. Disposed between the fixed block 114 and the yoke 116, and wrapped about the shaft 126, is a spring 118. In use, the strap is held tightly by wedging within the channel of the pulley 112 when the solenoid 120 is not energized, because the spring 118, which is in compression, pulls block 124 into close proximity with fixed block 114 (FIG. 6*a*). When the solenoid 120 is activated, the plunger 122 is drawn into the solenoid core causing the yoke 116 to move to the left and further compress spring 118. When the spring tension is overcome, the yoke 116, shaft 126, and block 124 move to the left, resulting in a loosening of the strap 110 about the pulley 112 and, thereby, permitting free movement of the shaft 58 (FIG. 6*b*).

Having disclosed a novel apparatus for assisting disabled persons and described illustrated embodiments and operations, modifications, additions, and subtractions are intended to be covered by the following claims.

What is claimed is:

1. Apparatus for repositioning a disabled person, said apparatus comprising:

a pair of parallel support rails extending horizontally;

a cradle assembly for placement under the person disposed beneath said support rails, the cradle assembly comprising:

a flexible support material extending between a first pair of foot end lifting points connected to the material and a second pair of head end lifting points also connected to the material and longitudinally spaced apart from said first points; and at least one stabilizing member connecting said first and second lifting points;

at least two first elongate support members attachable to said first pair of lifting points and at least two second elongated support members attachable to said second pair of lifting points on said cradle assembly, said support members being mounted for sliding horizontal movement along said rails;

first means for adjusting the length of both of said first support members between said cradle assembly and said rails to permit simultaneous raising and lowering of said first points on said cradle;

second means for adjusting the length of both of said second support members between said cradle assembly and said rails, independent of the length of said first support members, to permit simultaneous raising and lowering of said second lifting points on said cradle independent of said first lifting points and;

a control for actuating independently said first and second means for adjusting.

2. The apparatus of claim 1 wherein the first and second adjusting means further comprise first and second motor means, respectively, operable by a remote control device.

3. The apparatus of claim 2 wherein the apparatus further comprises at least one safety means for shutting off at least one of said motor means when the adjustment of the length of one of said first and second support members exceeds a predetermined amount.

4. The apparatus of claim 3 wherein the apparatus further comprises a second safety means for shutting off the motor power when the disabled person comes into close proximity with a carriage case surrounding said first and second adjusting means.

5. The apparatus of claim 2 further comprising at least one brake means for preventing the adjustment of the length of one of said first and second support members in the event that its corresponding motor means is deactivated.

6. The apparatus of claim 1 wherein the apparatus further comprises a third motor means for moving the support members horizontally along said rail.

7. The apparatus of claim 1 wherein the first and second adjusting means are supported on a frame which is connected to a bearing which slides along said parallel rails.

8. The apparatus of claim 7 wherein said bearings comprise U-shaped bearings disposed upon rounded surfaces of said parallel rails.

9. The apparatus of claim 7 wherein said bearings are non-rigidly connected to said frame to provide self-correction of misalignment of said parallel support rails.

10. The apparatus of claim 1 wherein said cradle assembly further comprises at least one transverse stiffening means to provide a shape for the flexible support material.

11. The apparatus of claim 1 wherein said stabilizing bar of said cradle assembly is a rigid bar which serves to maintain a fixed distance between said first and second lift points regardless of the relative positions of said support members.

* * * * *